United States Patent [19]

Cooper

[11] 4,121,304

[45] Oct. 24, 1978

[54] ARTICULATED MASK

[76] Inventor: Benjamin Cooper, 323 Derby Ave., Woodmere, L.I., N.Y. 11598

[21] Appl. No.: 782,048

[22] Filed: Mar. 28, 1977

[51] Int. Cl.[2] ..... A41G 7/02

[52] U.S. Cl. ..... 2/206; 46/161

[58] Field of Search ..... 2/206, 9, 173; 46/161, 46/171, 154

[56] References Cited

U.S. PATENT DOCUMENTS

| | | | |
|---|---|---|---|
| 587,687 | 8/1897 | Harder | 2/206 |
| 626,799 | 6/1899 | Walton | 2/206 |
| 1,035,217 | 8/1912 | McQuary, Jr. | 2/206 X |
| 3,089,148 | 5/1963 | Grossberg | 2/206 |
| 3,134,984 | 6/1964 | Ward | 2/206 |
| 3,183,622 | 5/1965 | Frankl | 46/154 |
| 3,307,202 | 3/1967 | Schuessler | 2/173 |

*Primary Examiner*—Peter Nerbun

*Attorney, Agent, or Firm*—Brumbaugh, Graves, Donohue & Raymond

[57] ABSTRACT

An ornamental face mask has an upper face portion and a lower jaw portion hinged together solely by elastic bands. The bands are located at the outer edges of the mask and bridge the upper face portion and the lower portion. The lower jaw portion is also designed so as to grip the chin of the wearer when the mask is held over his face by an elastic mounting strap.

7 Claims, 3 Drawing Figures

ARTICULATED MASK

BACKGROUND OF THE INVENTION

This invention relates to ornamental face masks and, more particularly, to face masks in which a jaw section is articulately connected to the rest of the mask.

Face masks are used in connection with costumes in theatrical productions, for masquerade parties, on Halloween and like occasions. These masks are typically made of thin flexible plastic material or paper stock and are designed to appear as the face of some well known or bizarre character.

In order to give a more life-like appearance to the mask it is known to provide a hinged lower jaw for the mask, which jaw moves with the jaw of the wearer such as when he speaks. In U.S. Pat. No. 626,799 to T. A. Walton, the lower jaw of the mask is hinged to the main part of the face by a pair of eyelets located at the opposite sides of the mask. Elastic straps bridging the two sections of the mask at locations adjacent both sides of the mouth keep the jaw in a closed position even when people with different size jaws wear it. The mask disclosed in U.S. Pat. No. 3,089,148 to A. Grossberg has an articulated jaw section including a pair of eyelets located respectively on the face and jaw sections on each side of the mask. An elongated slide bridges each pair of eyelets and permits the articulated lower jaw section to slide up and down with respect to the rest of the mask. An elastic band couples each pair of eyelets to urge the jaw toward its closed position and enable its motion to follow that of the wearer.

While the eyelets and elastic straps of the Walton mask or the eyelets, elongated slides and elastic bands of the Grossberg mask do provide a mask in which the lower jaw moves while the wearer talks, these prior art expedients have proved to be expensive both in the cost of materials and in manufacturing time. Moreover, the restraints on movement imposed by the fixed eyelet pivot of the Walton mask and the rigid slide of the Grossberg mask can cause discomfort and lack of realism, especially when the mask size does not correspond closely to that of the wearer's face.

SUMMARY OF THE INVENTION

The present invention is directed to providing a two-section articulated mask that avoids the shortcomings of the prior art by hinging the sections of the mask together solely with elastic bands, thereby permitting freedom of movement in all directions and increasing wearer comfort.

The elastic hinge bands are located adjacent each side of the mask and provide a degree of elasticity in all directions. The jaw portion can thus follow all of the natural jaw movements of the wearer, up-down, side-to-side, etc., thereby improving the realism of the mask and enhancing its comfort. Although facial proportions vary widely, the lower jaw of the mask is designed to be somewhat smaller in depth (i.e. teeth to chin) than the average human face so that when worn, the jaw portion is maintained snugly against the wearer's jaw by the tension of the elastic bands. This enables the mask jaw motion to follow that of the wearer more closely.

In an illustrative embodiment of the invention the mask comprises an upper face portion, which depicts the face of the character from his upper jaw to the top of his head, and a lower jaw portion hinged to the upper face portion by elastic bands. The elastic bands are located at the remote side edges of the mask and bridge the two portions of it. A strap for mounting the mask over the user's face is also provided. In addition to the usual eye openings and nose cavity, the lower jaw preferably is formed to grip the chin of the wearer to further enhance its movement with the jaw of the wearer.

Typically the mask is molded or stamped from thin flexible plastic sheets and, hence, may be made to resemble any desired character. As a result of the flexibility of the mask, the lower jaw portion will extend somewhat to grip the chin of users with different jaw sizes. The upper portion will also tend to conform to fit different size faces.

BRIEF DESCRIPTION OF THE DRAWINGS

The foregoing and other features of the present invention will be more readily apparent from the following detailed description and drawings of an illustrative embodiment of the invention in which.

DESCRIPTION OF AN EXEMPLARY EMBODIMENT

Figure 1:
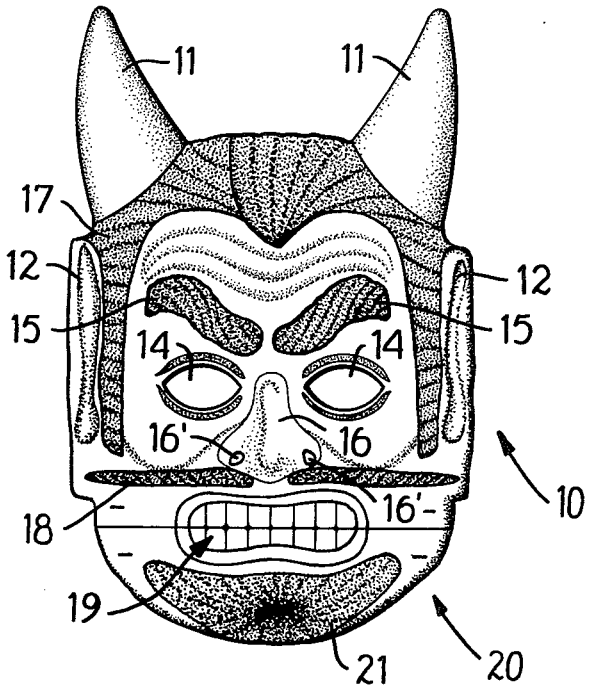
FIG. 1 is a front elevation view of a mask according to the present invention with the lower jaw closed.

The mask shown in the drawings depicts a devil face formed from molded or stamped sheets of thin flexible material, such as plastic or paper. The upper face portion 10 of the mask has horns 11 and elongated ears 12. The usual eyeholes 14 and nostral cavity 16 are also provided on the upper face portion. Bushy eyebrows 15 are located above the eyes and hair 17, including sideburns, covers the head. The nostril cavity 16 may have two nostril openings 16' to improve the realism of the mask and to make it more comfortable by allowing the warm breath of the user to escape. Beneath the nose is a mustache 18 and the upper part of a mouth 19, including the upper teeth.

Figure 3:
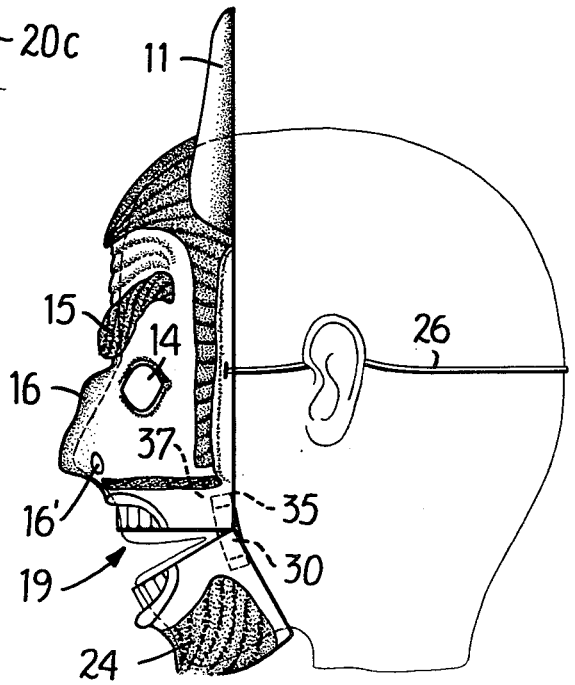
FIG. 3 is a side elevation of the mask of FIG. 1 showing the lower jaw open and gripping the chin of a wearer.

A lower face portion 20 of the mask shows the lower jaw of the devil including a goatee 21 and the lower part of mouth 19, including the lower teeth. As best seen in FIG. 3 the lower face portion is designed with a slight cavity 24 shaped to conform to the chin of the wearer (shown in dotted line). As a result, the lower face portion tends to follow the movement of the wearer's chin, e.g. when he is talking. Since the mask is made of thin flexible material, it will conform somewhat to fit different size faces and, more importantly, to grip the chins of users with different size jaws.

Elastic bands 30 located at the extreme side edges of the mask bridge the upper and lower face portions and establish an articulated connection between them. The bands may be fixed to the mask by means of staples 32. The bands themselves should have sufficient strength to keep the lower jaw pulled snugly against the user's chin when the mask is mounted over his face, e.g. by way of elastic strap 26 fixed to the upper face by staples 27. An elastic band having some substantial width (at least ¼ inch) is particularly useful because the edge 35 of the band at the extreme edge of the mask acts principally as a hinge joint and the edge 37 toward the center of the mask acts as a means for drawing the lower jaw up against the chin of the wearer (shown in dotted line in FIG. 3).

The use of a relatively wide elastic band 30 as the sole hinge member for each side of the jaw section provides a degree of flexibility in all directions, addding to the realism and comfort of the mask and increasing its ability to withstand rough usage. The elastic band, which may be of the type commonly used in clothing, is also less expensive than the eyelets and slides of the prior art devices.

Figure 2:
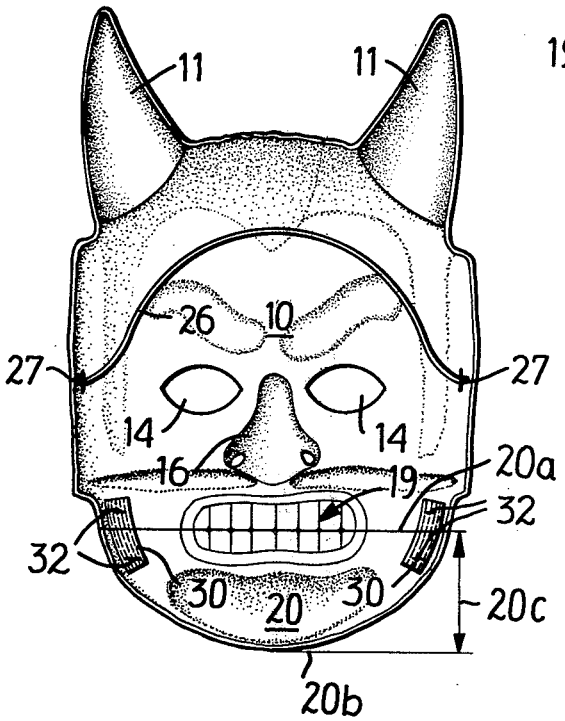
FIG. 2 is a rear elevation of the mask of FIG. 1.

To enhance further the comfort of the mask and the movement of the lower face portion 20, the depth of the latter, i.e. from the top of the teeth, 20*a* to the bottom of the jaw, 20*b*, is made somewhat less than the corresponding average dimension of the age group for which the mask is intended. This dimension is indicated in FIG. 2, at 20*c*, and preferably is such as to cause the lower portion 20 to be urged slightly downwardly against the tension of the bands 30.

While the invention has been particularly shown and described with reference to a preferred embodiment thereof, it will be understood by those skilled in the art that various changes in form and details may be made therein without departing from the spirit and scope of the invention. In particular, the present invention is not limited to any particular face depicted on the mask.

I claim:

1. An ornamental face mask comprising:

an upper face portion, said upper face portion depicting a face from the top of the head to the upper jaw;

a lower face portion, said lower face portion depicting the lower jaw of a face; and a plurality of elastic bands suitably attached to the upper and lower face portions for hinging the upper and lower face portions together, said elastic bands and their attachment to the face portions constituting the sole interconnection between said upper and lower face portions, at least one of said bands being located at each side edge of the mask so as to bridge the upper and lower face portions.

2. An ornamental face mask as claimed in claim 1 further including a mounting band for securing the mask to the face of the wearer, said band extending between the two side edges of the mask.

3. An ornamental face mask as claimed in claim 2 wherein the lower face portion is designed so as to grip the chin of the wearer when mounted over his face by the mounting band.

4. An ornamental face mask as claimed in claim 3 wherein the mounting band is an elastic band.

5. An ornamental face mask as claimed in claim 3 wherein at least the lower face portion is made of thin flexible plastic so as to be able to expand and comfortably grip the chin of wearers with different size jaws.

6. An ornamental face mask as claimed in claim 3 wherein the depth of said lower face portion from the top of the lower teeth to the bottom of the jaw is made less than the corresponding average dimension of the age group of wearers by which the mask is intended to be worn.

7. An ornamental face mask as claimed in claim 1 wherein the elastic bands are at least ¼ inch in width.

* * * * *